US009365322B2

(12) United States Patent
Simmonite

(10) Patent No.: US 9,365,322 B2
(45) Date of Patent: Jun. 14, 2016

(54) CARRIER BAGS

(76) Inventor: Richard Simmonite, Brighton (GB)

( * ) Notice: Subject to any disclaimer, the term of this patent is extended or adjusted under 35 U.S.C. 154(b) by 160 days.

(21) Appl. No.: 13/817,521

(22) PCT Filed: Aug. 19, 2011

(86) PCT No.: PCT/GB2011/051562

§ 371 (c)(1),
(2), (4) Date: Feb. 18, 2013

(87) PCT Pub. No.: WO2012/022981

PCT Pub. Date: Feb. 23, 2012

(65) Prior Publication Data

US 2013/0142454 A1 Jun. 6, 2013

(30) Foreign Application Priority Data

Aug. 20, 2010 (GB) ..... 1013998.8

(51) Int. Cl.

| | |
|---|---|
| ***B65D 30/00*** | (2006.01) |
| ***B65D 30/22*** | (2006.01) |
| ***B65D 33/00*** | (2006.01) |
| ***B65D 30/08*** | (2006.01) |
| ***B65F 1/00*** | (2006.01) |
| ***B65D 30/20*** | (2006.01) |
| ***B65D 33/06*** | (2006.01) |
| *B65F 1/06* | (2006.01) |

(52) U.S. Cl.

CPC ..... *B65D 33/00* (2013.01); *B65D 31/04* (2013.01); *B65D 31/10* (2013.01); *B65D 33/06* (2013.01); *B65F 1/0006* (2013.01); *B65F 2001/061* (2013.01)

(58) Field of Classification Search

CPC ..... B65D 81/363; B65D 81/368; B65D 33/00
USPC ..... 383/2, 38, 39, 40, 374, 4
See application file for complete search history.

(56) References Cited

U.S. PATENT DOCUMENTS

| | | | | |
|---|---|---|---|---|
| 2,943,781 | A * | 7/1960 | Goodrich | 383/200 |
| 3,411,264 | A * | 11/1968 | Farquhar | 53/456 |
| 4,299,324 | A * | 11/1981 | Dickens | 206/170 |
| 4,500,129 | A * | 2/1985 | Hahn | 294/172 |
| 4,723,300 | A * | 2/1988 | Aranow | 383/4 |
| 5,199,792 | A * | 4/1993 | Roosa | 383/4 |
| 5,210,891 | A * | 5/1993 | Avital et al. | 5/420 |
| 5,328,265 | A * | 7/1994 | Clooney | 383/4 |
| 6,523,989 | B2 * | 2/2003 | Carty | 366/129 |
| 7,188,713 | B1 * | 3/2007 | Espar et al. | 190/2 |
| 8,061,896 | B2 * | 11/2011 | Delgado | 383/4 |
| 2004/0136614 | A1 * | 7/2004 | Seidler | 383/4 |
| 2006/0191074 | A1 * | 8/2006 | Welch | 5/655 |

* cited by examiner

*Primary Examiner* — Jes F Pascua
*Assistant Examiner* — Derek Battisti
(74) *Attorney, Agent, or Firm* — Barnes & Thornburg LLP

(57) ABSTRACT

A double-walled carrier bag (1) has outer and inner walls that are joined at the opening (5) of the bag (1) and form double-walled side panels, each of which has a portion (4) that is folded to reduce the size of the panel and the opening (5) of the bag. A releasable fastener (3) holds each of the panels in its folded condition. When the fasteners (3) are released and the panels are unfolded, the walls of the carrier bag (1) can be reconfigured to form a single-walled sack (8).

17 Claims, 7 Drawing Sheets

CARRIER BAGS

The present invention relates to carrier bags, and in particular disposable carrier bags.

When making a purchase whilst out shopping, it is often the case that a shopper is provided with a carrier bag to assist with carrying their purchase away from the store. Supermarkets and other retail outlets typically provide one or more carrier bags at the checkout, according to the amount of goods being purchased. These carrier bags are typically disposable, and intended for a single use, being manufactured from a thin plastic such a polyethylene. Once a shopper reaches their final destination, and the goods unloaded, they are typically discarded, often by being thrown away.

There is a continuing trend to encourage recycling of waste products. In recent years, the disposal of carrier bags has become an issue. They usually comprise plastics that are not biodegradable and are discarded in such large numbers that they form a considerable proportion of plastics waste, that must be land-filled. In an attempt to reduce numbers, it is likely that shops and supermarkets will be banned from giving away free carrier bags in future. The shopper would be forced to buy reusable bags at the till, or to bring their own. Wales, for an example, has a ban coming into force at the end of 2010. Those carrier bags that are recyclable can of course be taken to or collected by council recycling facilities, in order to reduce the detrimental effect on the environment when they are simply discarded.

However, not all councils have the facilities for recycling carrier bags, and it is often the case that they are stored within the home until required for a further use, if ever a further use is found. Disposable carrier bags have been known to be reused for transporting other items, for the storage of items, or as waste receptacles. Occasionally a disposable shopping bag is used as a bin liner within a small waste bin within the home, or suspended from a kitchen cupboard to collect small quantities of kitchen waste products.

Shoppers are being encouraged to purchase reusable carrier bags in store, which are typically stronger in both materials and construction than a disposable carrier bag, being provided with reinforced handles and seams. This is hoped to reduce the amount of disposable carrier bags in circulation, by encouraging shoppers to return to the store with their own reusable carrier bag. However for many this is inconvenient in comparison to making use of disposable carrier bags that are available at the checkout, and are a widely used commodity.

However disposable carrier bags have not been designed to encourage reuse. Recycling facilities are not readily accessible, nor convenient, for all. The majority of homes build-up a large store of carrier bags, in case they find a further use for them. Whilst they are often used as refuse receptacles, forming a lining to a bin, or being suspended from a hook or door handle, there is a limit to how much waste they can contain in their existing form. They have not been designed for reuse as anything but a carrier bag, and have limited use as a refuse receptacle, such as a bin liner or refuse sack.

The prior art shows a number of ways of attempting to solve these problems.

GB 2,389,572 (Cotter) identifies the problem with the need to provide a second use for carrier bags, so that they are not just thrown away after their first use of transporting items home from a store. The problem has been addressed by converting a carrier bag into a refuse sack, thus providing a suitable second use for the carrier bag. Once emptied the carrier bag can be opened out so as to increase its capacity, thereby forming a larger bag that can more effectively be used as a refuse sack. However, whilst the capacity of the carrier bag is increased two-fold, by doubling the length of the bag, the diameter of the carrier bag does not change. The diameter of a typical carrier bag is unlikely to be of a suitable size for use as a refuse sack, and is therefore unlikely to fit the mouth of most waste bins.

NL 8,800,171 (Cornelis) proposes a carrier bag that can also be used as a rubbish sack. The carrier bag is of double walled construction, and by pulling out the inner wall and forming an inlet in the closed end by cutting off the closed portion, results in a refuse sack of single walled construction. However, whilst providing means to convert a carrier bag into a refuse sack, the means of expanding the bag only increases the length, thereby resulting in a refuse sack with the same sized opening as the carrier bag. Either the carrier bag has to have an oversized opening compared to the typical size, thereby rendering the refuse sack of suitable dimensions, or the carrier bag has a typically sized opening, and the refuse sack that results is rather narrow in construction and difficult to use.

All existing means of providing a carrier bag that can be extended to form a refuse sack or waste receptacle, limit the size of the mouth of the refuse receptacle to that of the carrier bag.

Preferred embodiments of the present invention aim to provide a carrier bag that can be extended to form a refuse receptacle, without unnecessary restraints on typical dimensions of refuse receptacle. A polythene carrier bag is configured to increase in capacity in such a way, that a second use as a refuse receptacle is comparable to use of an existing refuse sack. A paper carrier bag is configured to increase in capacity in such a way, that a second use as a refuse receptacle is comparable to storage boxes for recycling. In contrast to known methods of converting a carrier bag into a refuse receptacle, they recognise the fact that if a carrier bag is to be reused in a different way, such as a refuse receptacle, this second use must not be compromised due to limitations on size. Therefore, they set out to provide a carrier bag that can easily and conveniently be converted into a refuse receptacle, resulting in a refuse receptacle that is comparable to that which is typically used.

According to one aspect of the present invention, there is provided a carrier bag having outer and inner walls that are joined at the opening of the bag and form two substantially rectangular double-walled side panels, each of which has at least a portion that is folded to reduce the size of the panel and the opening of the bag; and releasable fastening means to hold each of the panels in its folded condition: the arrangement being such that, when the fastening means is released and the panels are unfolded, the walls of the carrier bag can be reconfigured to form a single-walled sack.

Preferably, the inner walls are pulled through the opening of the bag to form a closed, single-walled sack.

Preferably, the outer and inner walls are formed from a single piece of material.

Preferably, the carrier bag comprises at least one handle.

Said carrier bag may comprise a pair of handles, mounted opposite each other.

Preferably, the fastening means comprises a tab.

Said tab may incorporate a perforated portion.

Alternatively, said fastening means comprises adhesive that attaches the folded portion to the outer wall of the carrier bag.

Said fastening means may alternatively be formed during welding of the carrier bag.

Said carrier bag may comprise a gusseted base.

Said carrier bag may comprise a plurality of side gussets.

Said carrier bag may comprise a gusset between each of the side panels.

Preferably, the single-walled sack incorporates a perforated portion for forming an opening in the sack.

Said means for forming an opening may comprise a cutting line provided at one end of the single-walled sack to indicate an opening in the sack when cut.

Preferably, the single-walled sack is substantially twice the size of the double-walled carrier bag.

Said carrier bag may be formed of polythene.

Said carrier bag may alternatively be formed of a biodegradable material, such as polycaprolactone.

The invention also extends to a method of converting a double-walled carrier bag into a single-walled sack, comprising the steps of releasing releasable fastening means to unfold folded side panels of the bag, and reconfiguring the walls of the carrier bag to form said sack.

According to an alternative aspect of the present invention, there is provided a carrier bag having a multi-walled side portion in which the walls are folded together; the arrangement being such that the walls may be unfolded outwardly from the carrier bag to form a receptacle that opens into the carrier bag.

Preferably, the multi-walled side portion comprises an inner wall and an outer wall, joined together by gusseted portions, the outer wall and the gusseted portions comprising a plurality of layers of material, such that when unfolded from the carrier bag, the receptacle is formed.

Preferably, the inner wall of the multi-walled side portion when unfolded becomes the uppermost wall of the receptacle.

Said carrier bag may be formed of paper.

Said carrier bag may alternatively be formed of cardboard.

Said carrier bag may also be formed of a biodegradable material.

Said carrier bag may comprise a base and gusseted side portions.

The invention also extends to a method of expanding a carrier bag, comprising the steps of unfolding a multi-walled side portion of the bag, and shaping the multi-walled side portion outwardly from inside the carrier bag to form a receptacle that opens into the carrier bag.

For a better understanding of the invention and to show how embodiments of the same may be carried into effect, reference will now be made, by way of example, to the accompanying diagrammatic drawings, in which.

In the figures, like references denote like or corresponding parts.

Figure 1:
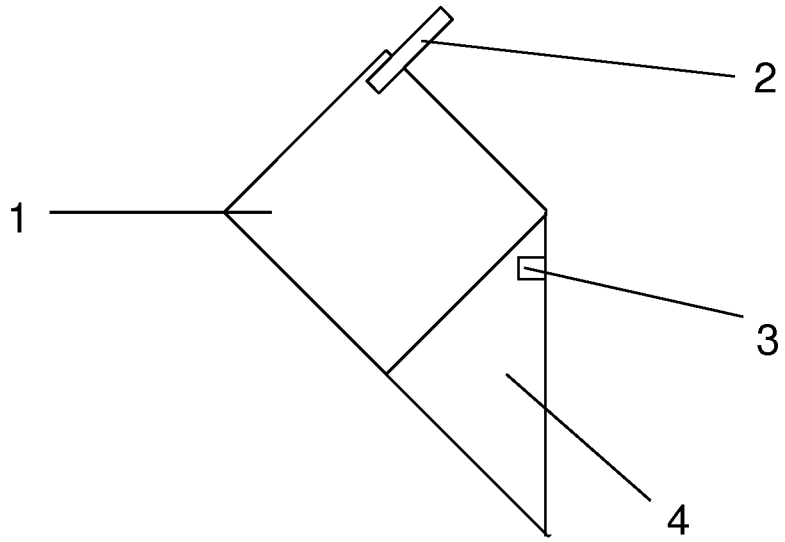
FIG. 1 illustrates one example of an embodiment of a double-walled carrier bag in side view, in a stored position.

The carrier bag 1, as shown in FIG. 1, comprises as many attributes as possible to replicate existing carrier bags that are well-known in the art. The carrier bag 1 is made from a flexible material, with properties that allow the carrier bag 1 to be easily compressed, folded and unfolded or scrunched, before and after use. Said material being deemed to be memoryless with zero shape recovery. An example of such a material, and one that is typically used for carrier bags, is polythene. The carrier bag 1 may comprise a recycled and degradable plastic material for environmentally friendly purposes. The carrier bag 1 is also double-walled in construction. Both walls of the carrier bag 1 may be formed from the same piece of material, folded inside itself, or may be formed from separate pieces that are welded or joined together.

An alternative carrier bag 1 may comprise a compostable carrier bag 1, made from biodegradable materials. A biodegradable bag is one that has been made from materials that are able to decompose, typically polymers combined with corn-based materials, paper or organic materials. An example of such a material is polycaprolactone. A carrier bag 1 that has been made from a biodegradable material can therefore be used to store kitchen waste products such as vegetable peelings, and the entire carrier bag 1 can be placed on a compost heap to decompose.

The carrier bag 1 may comprise one or more handles 2 for ease of transporting the carrier bag 1 and the goods contained within. The carrier bag may also incorporate a base portion that may or may not be gusseted. When the carrier bag 1 is suspended from a rack within a store, along with a number of other carrier bags 1 ready for use by a purchaser, the folded configuration as shown in FIG. 1 presents one way in which the carrier bag 1 may be displayed and stored. It can also be folded further for convenience of carrying within a handbag or otherwise, and for storage when not required.

Figure 2:
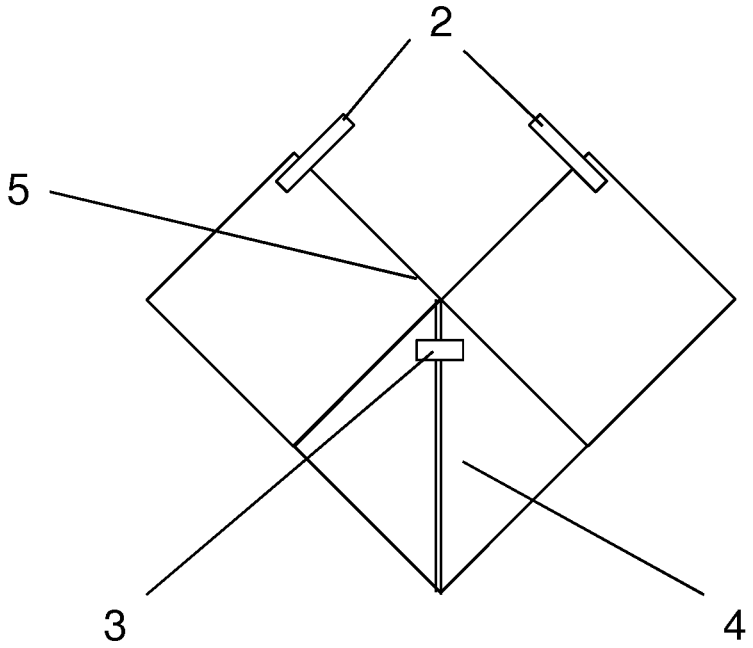
FIG. 2 shows a side view of the double-walled carrier bag of FIG. 1 showing one example of location of fastening means for a folded portion.
Figure 4:
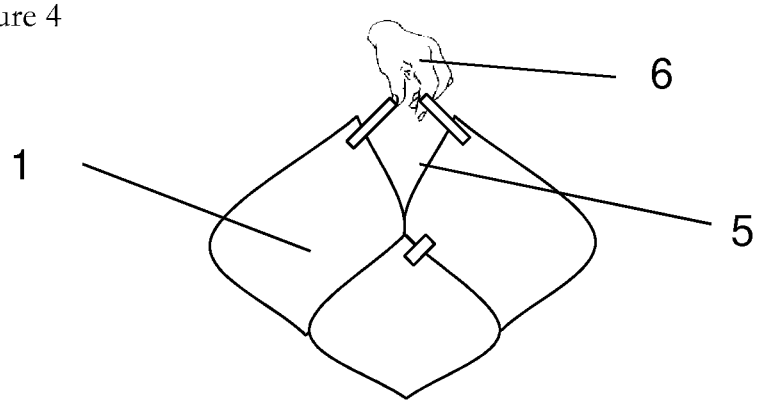
FIG. 4 shows a side view of the carrier bag of FIG. 3 when handles are held together.

As shown in FIG. 2, the carrier bag 1 comprises a folded portion 4 that is held in a folded state by fastening means 3. The folded portion allows the carrier bag 1 to be expanded to form a refuse sack 8 when required. The fastening means 3 ensures that when the carrier bag 1 is being used as a carrier bag 1, the opening 5 is maintained at a suitable size for use in this form. The fastening means 3 also ensures that the handles 2 remain a convenient distance apart for a user that is using the carrier bag 1, as shown in FIG. 4.

Figure 3:
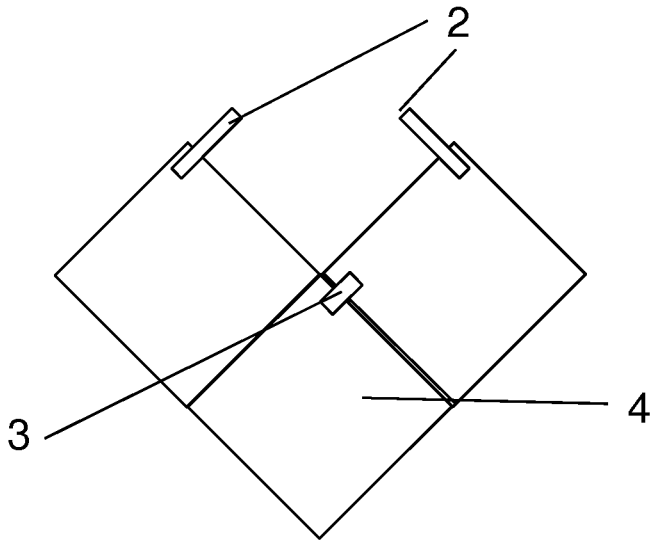
FIG. 3 shows a side view of the double-walled carrier bag of FIG. 1 showing a further example of location of fastening means for the folded portion.

The carrier bag 1 as shown in FIG. 2, comprises creased folds within the folded portion 4, and is folded such that the fastening means 3 is centrally placed. The folded portion 4 and fastening means 3 are replicated on the opposing side of the carrier bag 1, not shown. A further configuration of folded portion 4 and fastening means 3 is shown in FIG. 3, whereby the fastening means 3 is configured such that the folded portion 4 is held by the fastening means 3 to one side. The folded portion 4 and fastening means 3 of FIG. 3 can again be replicated on the opposing side of the carrier bag 1, not shown.

The carrier bag 1 may incorporate just one folded portion 4, or may comprise a plurality of folded portions 4 at various locations about the periphery of the opening 5 of the carrier bag 1. The folded portions 4 are configured such that when unfolded and flattened, the carrier bag 1 is of a substantially rectangular shape, with an increase in size of the opening 5, to replicate the size of the base of the carrier bag 1. The folded portions 4 may extend the height of the carrier bag 1, from base to opening 5, as shown in FIG. 3. The folded portion 4 might also extend a proportion of the height of the carrier bag 1, not shown.

The fastening means 3 may comprise an adhesive tab or portion that can be easily cut with scissors, torn or detached by other means. The fastening means 3 may also comprise a perforated line to enable the folded portion 4 to be easily detached for unfolding purposes. The folded portion 4 may also be retained by a welded seam formed during the manufacturing process for the carrier bag 1, said seam being sufficiently weak to enable it to be pulled apart, thus releasing the folded portion 4.

The fastening means 3 may fasten the folded portions 4 from the opening 5 right through to the base of the carrier bag 1, or may fasten the folded portions 4 for a portion of the length. Each folded portion 4 may be fastened by a plurality of fastening means 3.

FIG. 4 shows the carrier bag 1 when in use and laden with goods. The hand 6 of a user grasps the handles 2 of the carrier bag 1, closing the opening 5 to prevent items contained within the carrier bag 1 from falling out.

Figure 5:
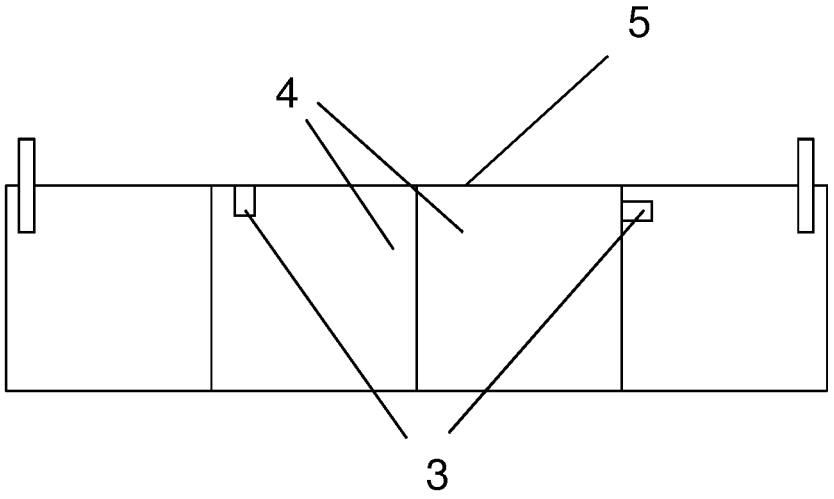
FIG. 5 shows a side view of the carrier bag of FIG. 3 when fastening means have been unfastened and the folded portion unfolded.
Figure 6:
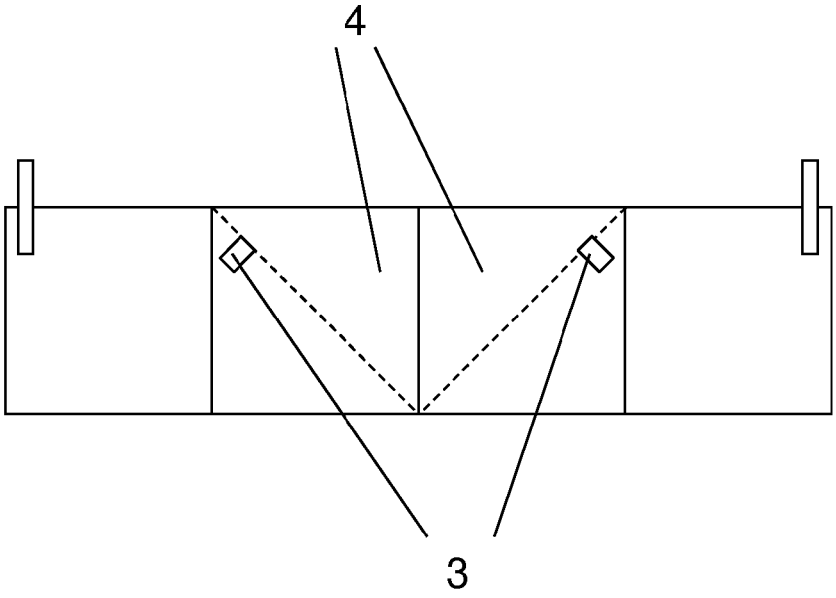
FIG. 6 shows a side view of the carrier bag of FIG. 2 when the retaining means have been released and the folded portion unfolded.

When the fastening means 3 has been detached, and the folded portions 4 released and unfolded, the carrier bag 1 takes on the substantially rectangular shape as shown in FIG. 5, and in a further configuration in FIG. 6. The opening 5 is comparable in size to the base of the carrier bag 1.

Figure 7:
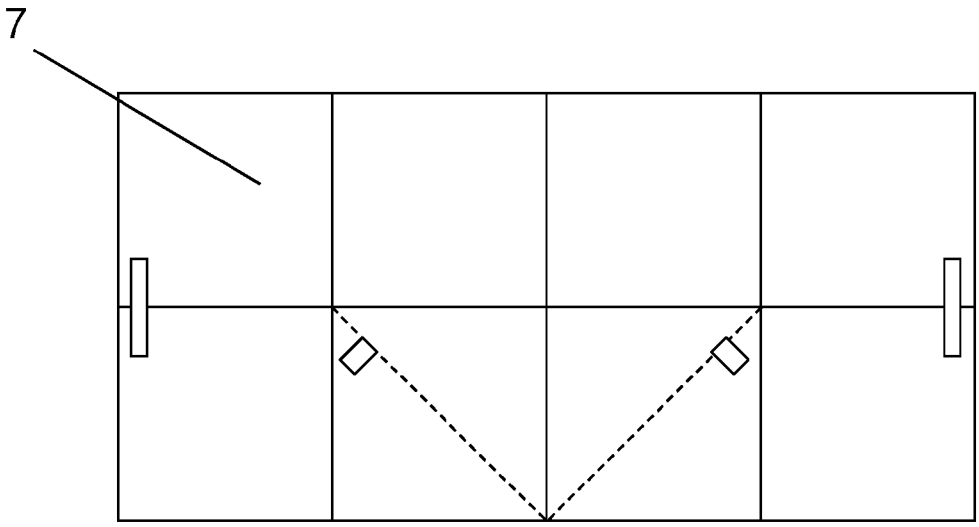
FIG. 7 shows a side view of the carrier bag of FIG. 6 with a lining pulled out.

The carrier bag 1 is double-walled in construction, incorporating outer and inner walls 7. This increases the strength of the carrier bag 1, and increases the load bearing capacity. As shown in FIGS. 5 and 7, the inner wall 7 is attached to the outer wall of the carrier bag 1 about the opening 5 of the carrier bag 1. Thus the inner wall 7 can be pulled right through the opening 5 of the carrier bag 1, until the inner wall 7 is substantially the same size and shape as the outer wall of the original carrier bag 1. There are then effectively no openings within the carrier bag 1, and the resulting body comprises a sealed unit, or single-walled sack 8.

Figure 8:
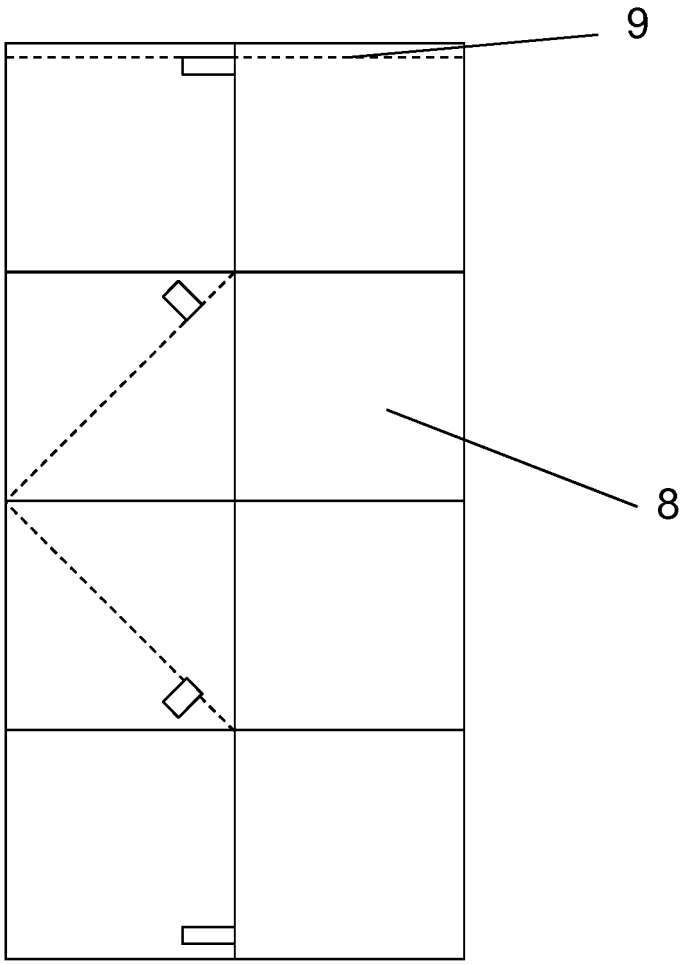
FIG. 8 shows a side view of the carrier bag of FIG. 7 when reconfigured as a refuse sack.

The carrier bag 1 with the inner wall 7 pulled right through, is of a convenient size and shape for use as a refuse sack 8, as shown in FIG. 8. The refuse sack 8 of FIG. 8 requires a sack opening 9 to be made to allow refuse to be placed within the refuse sack 8. A convenient location for such a sack opening 9 would be along one edge or side of the refuse sack 8, which formed a side of the original carrier bag 1. The sack opening 9 is therefore substantially perpendicular to the opening 5 of the carrier bag 1 before the transformation to a refuse sack 8 was undertaken. The refuse sack 8 may comprise markings, printed or otherwise, of where to cut along in order to form the sack opening 9. The refuse sack 8 may otherwise incorporate a perforated line, that when torn along this line, the sack opening 9 is formed. The refuse sack 8 may alternatively comprise a line of weakness in the material that can be pulled apart by a user to form the sack opening 9 in a suitable location for use as a refuse sack 8. The sack opening 9, and markings or lines from which to make said opening 9, may be a straight line, spanning the width of the refuse sack 8, but may also be of a different shape. The sack opening 9 may incorporate ties for use to close the opening 9 of the refuse sack, or might also incorporating handle means.

Figure 9:
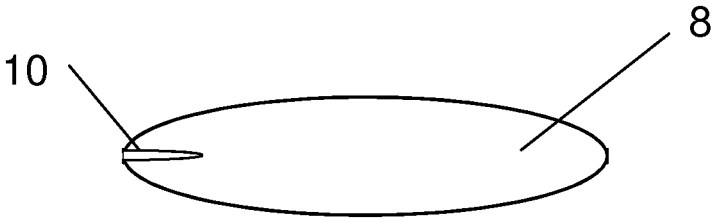
FIG. 9 shows a perspective view of the refuse sack of FIG. 8.

In one embodiment, the carrier bag 1 is formed from an extruded polythene film rectangle that is first folded in half and sealed along all open sides, forming the single-walled sack 8. Next a portion of the single-walled sack is folded inside itself, to form the double-walled carrier bag 1. Each side panel is further folded upon itself to form folded portions 4 within the side panel in each outer wall, that are retained by fastening means 3. FIG. 9 shows a perspective view of the refuse sack 8 of FIG. 8. Should the carrier bag 1 have incorporated a base 10, gusseted or otherwise, FIG. 9 shows the base 10 before it has been opened out to form a refuse sack 8.

Figure 10:
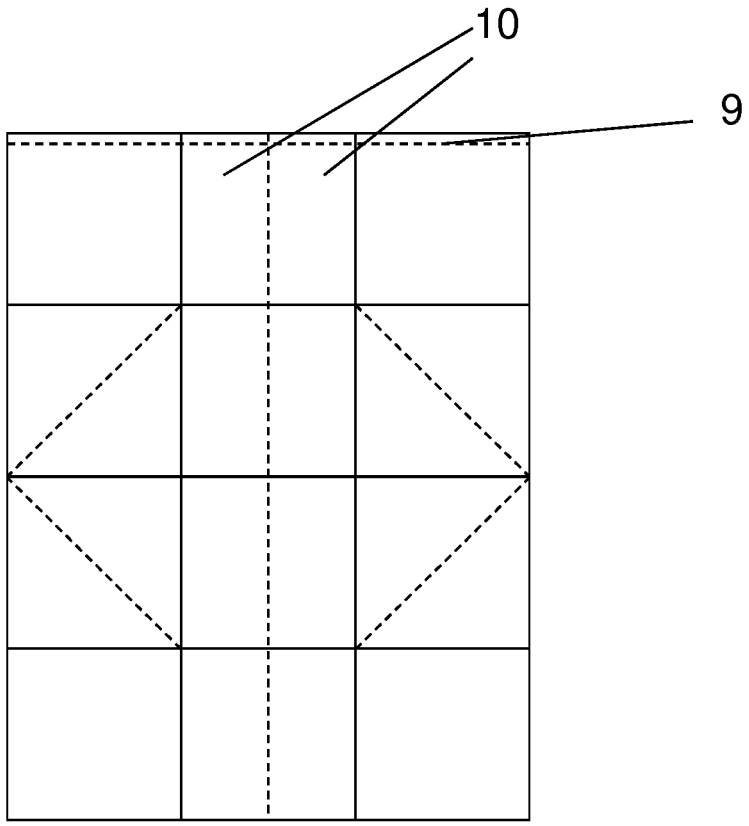
FIG. 10 shows one example of a cutting template to form the carrier bag of FIG. 3.

FIG. 10 shows one example of the pattern or template from which the carrier bag 1 may be formed. The temporary folds of the folded portion 4 are shown as dotted lines. The sack opening 9 is also shown along one side of the refuse sack 8 which effectively forms the top edge of the refuse sack 8. The pattern is intended for use with blown film extrusions processes, incorporating a cylindrical circumference of 1200 mm for example. Once laid out flat the carrier bag 1 is typically formed by cutting and heat sealing.

Figure 14:
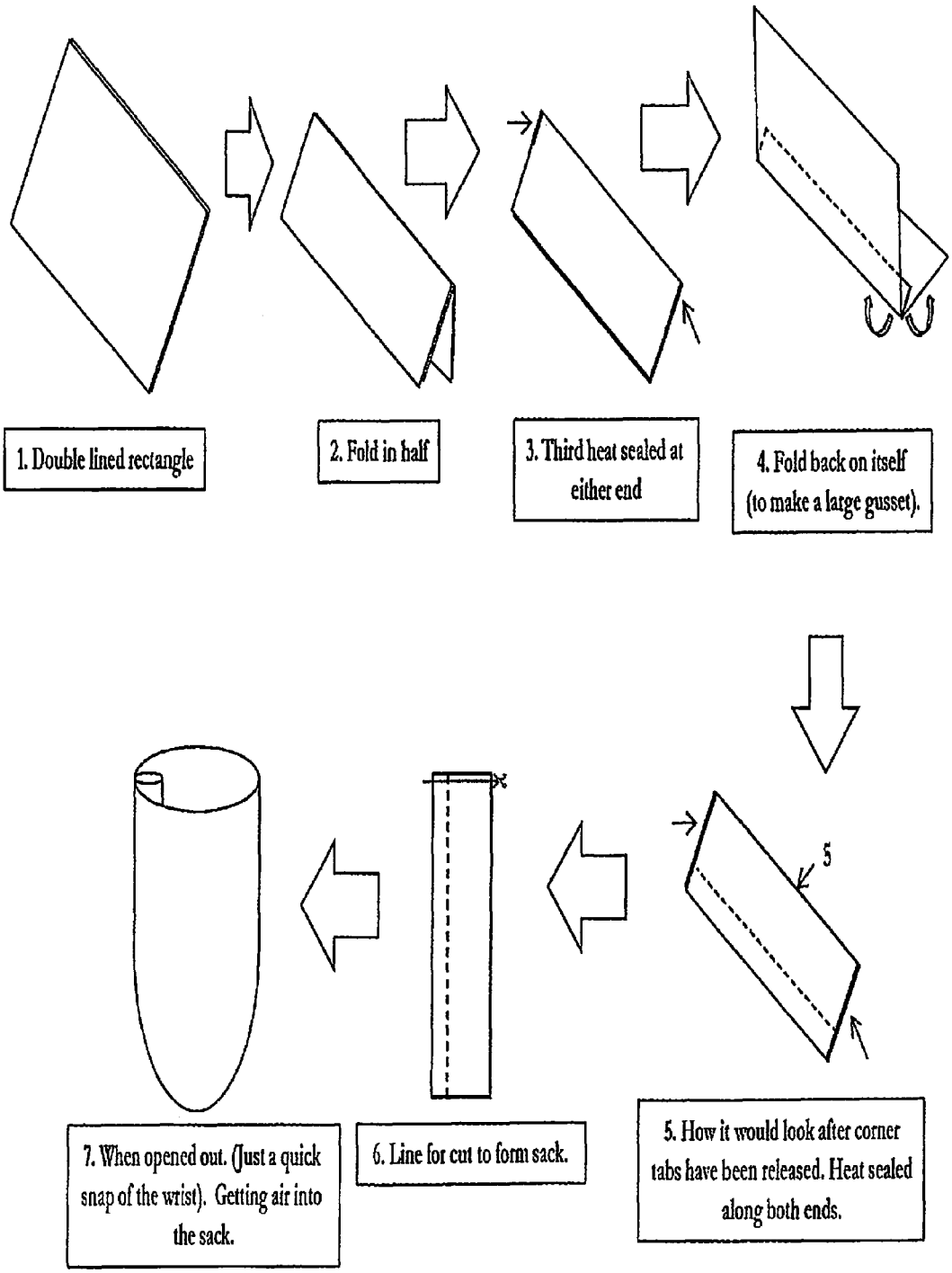
FIG. 14 illustrates a sequence of steps for forming a carrier bag and sack, in an alternative method.

FIG. 14 illustrates a sequence of steps for forming a carrier bag and sack, in an alternative method. The carrier bag may be formed in such a way that the base of the carrier bag is provided with strengthening means, to help support heavy loads.

In steps 1 and 2, a double-walled panel of substantially rectangular shape is firstly folded in half along a long edge. In step 3, approximately ⅓ of each short end of the folded panel is heat sealed. In step 4, each double-walled side portion that has not been heat-sealed is folded upwardly (as seen), to form a large gusset. In step 5, the short ends of the folded panels are heat sealed again, this time along their full lengths, to leave an opening 5 at one of the long sides, and the gusset along the opposite long side. The configuration as shown in step 5 is analogous to that shown in FIGS. 5 and 6 and, in a similar manner, a carrier bag may be formed along the lines described above with reference to the preceding embodiments, with folded side panels and releasable tabs, etc. In FIG. 14, however, the large gusset affords extra strength.

To form a sack in FIG. 14, the folded side panels of the carrier bag 1 are released to resume the configuration shown in step 5. In step 6, one end of the unfolded bag is cut off or opened in any other suitable manner, as previously described. A flick of the bag then allows the folded side portions to unfold, leaving a substantially single-walled sack as shown in step 7, where the heat-sealed portions at the base of the sack provide reinforcement.

Figure 11:
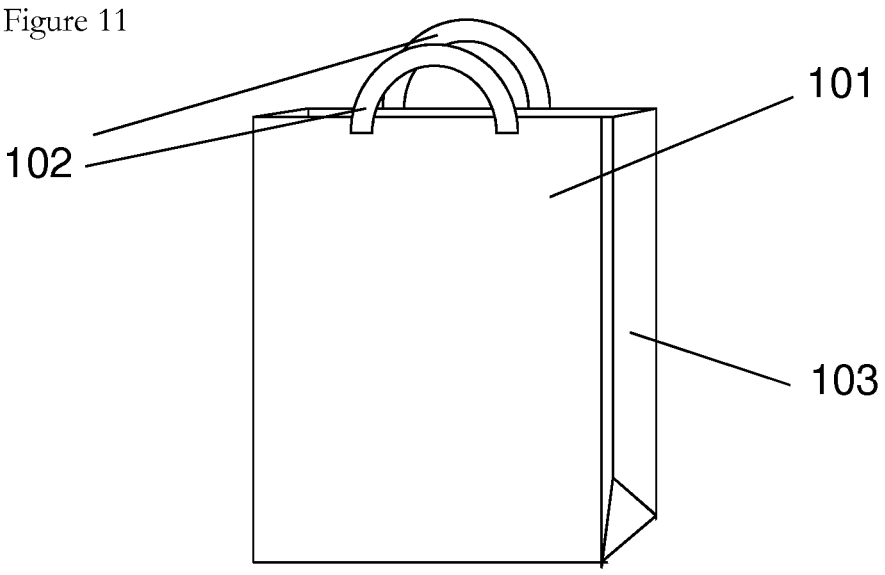
FIG. 11 illustrates one example of an embodiment of another carrier bag in isometric view.

The carrier bag 101 of FIG. 11 comprises a carrier bag 101 that is typically made from one or more layers of paper, or thin cardboard. This type of carrier bag 101 is often used when transporting items such as clothing home from a shop. The carrier bag 101 may comprise a base and side gussets 103 and may also comprise one or more handles 102.

Figure 12:
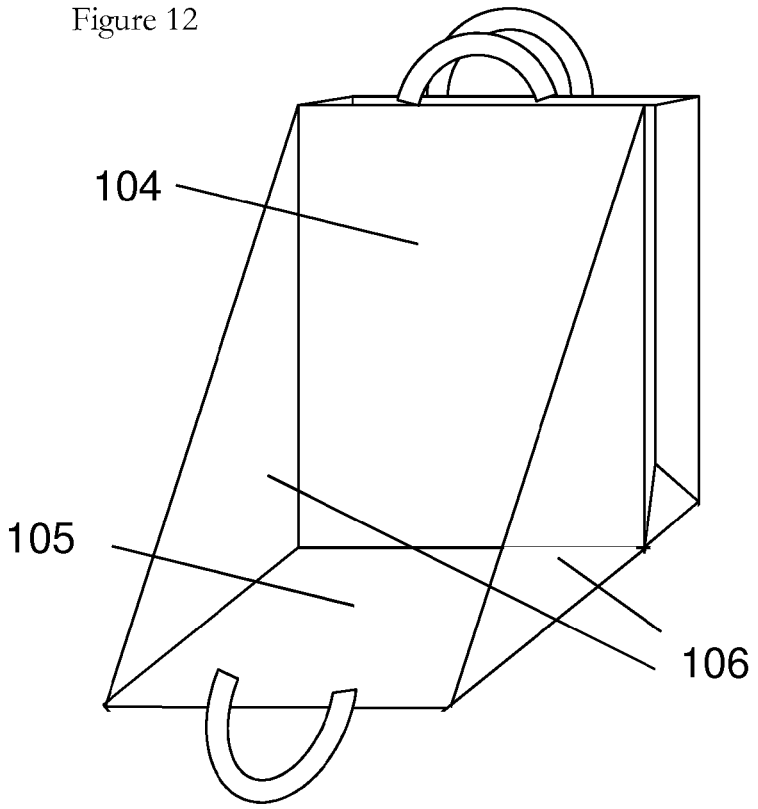
FIG. 12 shows the carrier bag of FIG. 11 with side portion unfolded.

As shown in FIG. 12, the carrier bag 101 incorporates a multi-walled side portion comprising an inner wall 104 and an outer wall 105 within one side of the carrier bag 101. Both the inner wall 104 and the outer wall 105 are connected in such a way that when unfolded outwardly from the carrier bag 101, they form a receptacle or box 107 that opens into the carrier bag 101.

In one embodiment, the inner wall 104 and outer wall 105 are joined along their bottom edge and by triangular gussets 106 on either side edge. When the outer wall 105 is unfolded from the inner wall 104, the outer wall 105 drops down until it lies flat with the base of the carrier bag 101, and the triangular gussets 106 open out to support the outer wall 105 in position.

Figure 13:
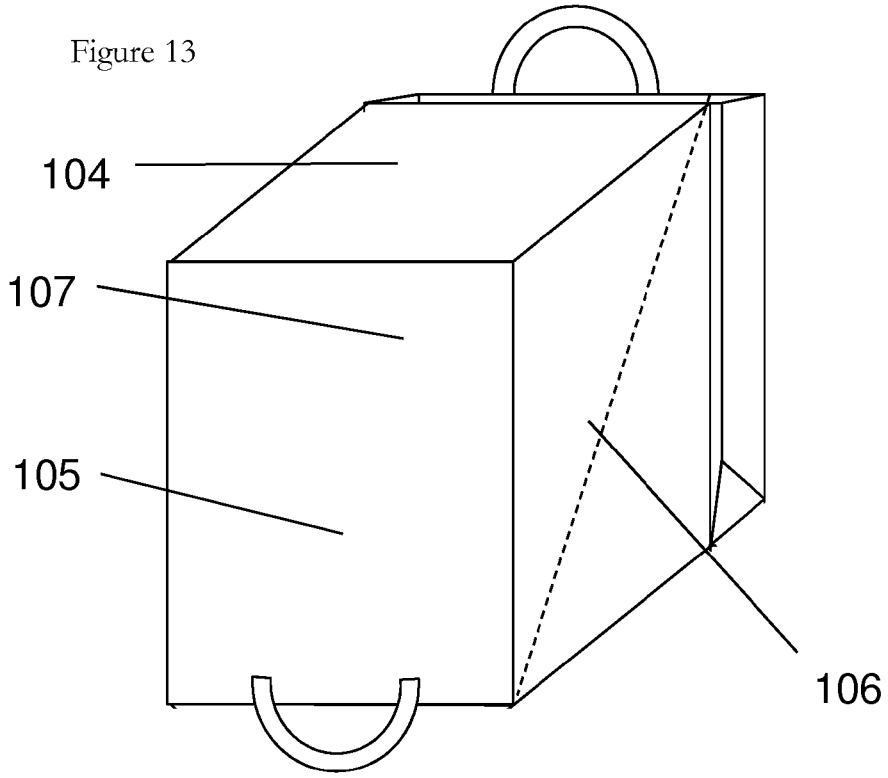
FIG. 13 shows the carrier bag of FIGS. 11 and 12 when unfolded to form a box.

The outer wall 105 and the triangular gussets 106 comprise two layers of material, whereby when the inner wall 104 is pushed outwards from the inside of the carrier bag 101, the inner wall forms the top wall of the box 107, and the two layers of the outer wall 105 and triangular gussets 106 unfold from each other to create the sides and a further wall of the box 107, as shown in FIG. 13.

In use, waste is inserted into the box 107 through the original opening of the carrier bag. The box 107 may be oriented as illustrated in FIG. 13. Alternatively, it may be rotated through 90 degrees, such that the outer wall 105 becomes the base of the box 107.

When full, the box 107 may be discarded, or emptied and reused so long as it retains sufficient strength.

In this specification, the verb "comprise" has its normal dictionary meaning, to denote non-exclusive inclusion. That is, use of the word "comprise" (or any of its derivatives) to include one feature or more, does not exclude the possibility of also including further features.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A multi-walled carrier bag that is convertible to a single-walled sack, the carrier bag comprising:

two substantially rectangular side panels that are joined to one another to form sides of the carrier bag;

an opening of the carrier bag that is defined by the side panels; and a releasable fastening means for each of the side panels that holds the respective side panel in a folded condition:

wherein:

each of the side panels is formed of a double-walled material that affords inner and outer walls of the carrier bag;

the inner wall of the carrier bag is joined to the outer wall of the carrier bag only at the opening of the carrier bag;

each of the side panels is folded to reduce the size of the respective side panel and the size of the opening of the carrier bag, such that the folded portion of the respective side panel doubles the double-walled material to afford at least four superposed walls; and upon releasing the releasable fastening means and unfolding the folded portions of the side panels, said inner walls of the carrier bag may be pulled through the opening of the carrier bag to form said single-walled sack, which is formed from said inner and outer walls and has greater overall dimensions than the carrier bag.

2. A double-walled carrier bag according to claim 1, wherein the outer and inner walls are formed from a single piece of material.

3. A double-walled carrier bag according to claim 1, wherein the carrier bag comprises at least one handle.

4. A double-walled carrier bag according to claim 3, wherein the carrier bag comprises a pair of handles, mounted opposite each other.

5. A double-walled carrier bag according to claim 1, wherein the fastening means comprises a tab.

6. A double-walled carrier bag according to claim 5, wherein the tab incorporates a perforated portion.

7. A double-walled carrier bag according to claim 1, wherein the fastening means comprises adhesive that attaches the folded portion to the outer wall of the carrier bag.

8. A double-walled carrier bag according to claim 1, wherein the carrier bag is formed by welding and the fastening means is formed during welding of the carrier bag.

9. A double-walled carrier bag according to claim 1, wherein the carrier bag comprises a gusseted base.

10. A double-walled carrier bag according to claim 1, wherein the carrier bag comprises a plurality of side gussets.

11. A double-walled carrier bag according to claim 10, wherein the carrier bag comprises a gusset between each of the side panels.

12. A double-walled carrier bag according to claim 1, wherein the single-walled sack incorporates a perforated portion for forming an opening in the sack.

13. A double-walled carrier bag according to claim 1, wherein a cutting line is provided at one end of the single-walled sack to indicate an opening in the sack when cut.

14. A double-walled carrier bag according to claim 1, wherein the single-walled sack is substantially twice the size of the double-walled carrier bag.

15. A double-walled carrier bag according to claim 1, formed of polythene.

16. A double-walled carrier bag according to claim 1, formed of a biodegradable material, such as polycaprolactone.

17. A multi-walled carrier bag that is convertible to a single-walled sack, the carrier bag comprising:

two substantially rectangular side panels that are joined to one another to form sides of the carrier bag with a gusseted base of the carrier bag between the side panels;

an opening of the carrier bag that is defined by the side panels;

at least one carrying handle on the carrier bag; and a releasable fastening means for each of the side panels that holds the respective side panel in a folded condition:

wherein:

each of the side panels is formed of a double-walled material that affords inner and outer walls of the carrier bag;

the inner wall of the carrier bag is joined to the outer wall of the carrier bag only at the opening of the carrier bag;

each of the side panels is folded to reduce the size of the respective side panel and the size of the opening of the carrier bag, such that the folded portion of the respective side panel doubles the double-walled material to afford at least four superposed walls;

upon releasing the releasable fastening means and unfolding the folded portions of the side panels, said inner walls of the carrier bag may be pulled through the opening of the carrier bag to form said single-walled sack, which is formed from said inner and outer walls and has greater overall dimensions than the carrier bag;

said releasable fastening means comprises an adhesive tab for each of the side panels; and the single-walled sack incorporates a perforated portion for forming an opening at an end of the sack.

* * * * *